US006655172B2

(12) United States Patent
Perevozchikov et al.

(10) Patent No.: US 6,655,172 B2
(45) Date of Patent: Dec. 2, 2003

(54) SCROLL COMPRESSOR WITH VAPOR INJECTION

(75) Inventors: Michael Perevozchikov, Troy, OH (US); Roy Doepker, Lima, OH (US)

(73) Assignee: Copeland Corporation, Sidney, OH (US)

( * ) Notice: Subject to any disclaimer, the term of this patent is extended or adjusted under 35 U.S.C. 154(b) by 79 days.

(21) Appl. No.: 10/057,216

(22) Filed: Jan. 24, 2002

(65) Prior Publication Data

US 2003/0136145 A1 Jul. 24, 2003

(51) Int. Cl.[7] ..... F25B 39/04; F25B 31/00
(52) U.S. Cl. ..... 62/505; 62/509
(58) Field of Search ..... 62/505, 509, 513, 62/113, 197; 417/366; 418/83, 86, 55.2, 55.6, 97

(56) References Cited

U.S. PATENT DOCUMENTS

| | | | | |
|---|---|---|---|---|
| 1,614,676 | A | | 1/1927 | Kercher |
| 2,130,835 | A | | 9/1938 | Bixler |
| 2,134,936 | A | | 11/1938 | Getchell et al. |
| 2,151,565 | A | | 3/1939 | Robinson |
| 2,215,991 | A | | 9/1940 | Anderson et al. |
| 2,300,005 | A | | 10/1942 | Philipp |
| 2,540,062 | A | | 1/1951 | Touborg |
| 4,607,503 | A | | 8/1986 | Fry |
| 4,669,279 | A | | 6/1987 | Maeda et al. |
| 4,854,373 | A | | 8/1989 | Williams |
| 5,103,652 | A | * | 4/1992 | Mizumo et al. ..... 62/505 |
| 5,447,420 | A | * | 9/1995 | Caillat et al. ..... 418/55.5 |
| 5,466,136 | A | | 11/1995 | Yamada et al. |
| 5,469,716 | A | * | 11/1995 | Bass et al. ..... 62/505 |
| 5,692,389 | A | | 12/1997 | Lord et al. |
| 5,722,257 | A | * | 3/1998 | Ishii et al. ..... 62/505 |
| 5,752,391 | A | * | 5/1998 | Ozaki et al. ..... 62/228.1 |
| 5,816,055 | A | | 10/1998 | Ohman |
| 5,873,261 | A | | 2/1999 | Bae |
| 5,996,364 | A | * | 12/1999 | Lifson et al. ..... 62/196.1 |
| 6,041,609 | A | | 3/2000 | Hornsleth et al. |
| 6,089,031 | A | | 7/2000 | Stegner et al. |
| 6,106,253 | A | * | 8/2000 | Sakai et al. ..... 418/55.6 |
| 6,213,731 | B1 | * | 4/2001 | Doepker et al. ..... 417/310 |
| 6,374,631 | B1 | * | 4/2002 | Lifson et al. ..... 62/505 |
| 6,430,959 | B1 | * | 8/2002 | Lifson ..... 62/505 |
| 2002/0062656 | A1 | * | 5/2002 | Suitou et al. ..... 62/259.2 |

* cited by examiner

*Primary Examiner*—Marc Norman
(74) *Attorney, Agent, or Firm*—Harness, Dickey & Pierce, P.L.C.

(57) ABSTRACT

A refrigeration system has a compressor which incorporates fluid injection into one or more of the fluid pockets. A source of fluid for injection into the pockets is attached directly to the shell of the compressor to eliminate the need for having fluid piping between the source of fluid and the compressor. The source of fluid can be a flash tank which increases the capacity and efficiency of the system or the source of fluid can be a heat exchanger which also increases the capability and efficiency of the system.

22 Claims, 4 Drawing Sheets

SCROLL COMPRESSOR WITH VAPOR INJECTION

FIELD OF THE INVENTION

The present invention relates to scroll type machines. More particularly, the present invention relates to hermetic scroll compressors incorporating a vapor injection system which utilizes a heat exchanger or a flash tank which is mounted directly to the shell of the scroll compressor.

BACKGROUND AND SUMMARY OF THE INVENTION

Refrigeration and air conditioning systems typically include a compressor, a condenser, an expansion valve or equivalent and an evaporator. These components are coupled in sequence in a continuous serial flow path. A working fluid or refrigerant flows through the system and alternates between a liquid phase and a vapor or gaseous phase.

A variety of compressor types have been used in refrigeration and air conditioning systems, including but not limited to reciprocating compressors, screw compressors and rotary compressors. Rotary compressors can include both the vane type compressors as well as the scroll machines. Scroll machines are constructed using two scroll members with each scroll member having an end plate and a spiral wrap extending generally perpendicular to the respective end wrap. The spiral wraps are arranged in an opposing manner with the two spiral wraps being interleaved or interfitted with each other. The scroll members are mounted so that they may engage in relative orbiting motion with respect to each other. During this orbiting movement, the spiral wraps define a successive series of enclosed pockets or spaces, each of which progressively decreases in size as it moves inwardly from a radially outer position at a relatively low suction pressure to a central position at a relatively higher or discharge pressure. The compressed fluid exits from the enclosed space at the central position through a discharge passage formed through the end plate of one of the scroll members.

Refrigeration and air conditioning systems are now incorporating vapor injection systems where a portion of the refrigerant in gaseous form is injected into the enclosed pockets or spaces at a pressure which is intermediate the low suction pressure and the relatively high discharge pressure. This gaseous refrigerant is injected into the enclosed pockets or spaces through one or more injection ports which extend through one of the two scroll members. The injection of this gaseous refrigerant has the effect of increasing both the refrigeration or air conditioning system's capacity and the efficiency of the refrigeration or air conditioning system. In refrigeration or air conditioning systems where vapor injection is incorporated to achieve maximum capacity and maximum efficiency increases, the development engineer attempts to provide an injection system which will maximize the amount of refrigerant gas that is injected into the enclosed pocket as well as maximizing the intermediate pressure at which the refrigerant gas is injected into the enclosed pocket. By maximizing both the amount of refrigerant gas as well as the pressure of the refrigerant gas that is injected, the system capacity and the system efficiency of the refrigeration or air conditioning system are maximized.

When developing the vapor injection system, the development engineer must consider the source for the vapor that is injected into the pockets. Typically, the vapor refrigerant source is through a connection at a position within the refrigeration circuit and a device such as a flash tank or an economizer is utilized to separate vapor refrigerant from gaseous refrigerant to ensure that only gaseous or vapor refrigerant is injected into the enclosed pockets or spaces. When accessing liquid refrigerant from a position within the refrigeration circuit, the vapor or gaseous refrigerant is typically piped to the compressor through a fluid line which extends between the position within the refrigeration circuit and the compressor. The use of fluid piping between the source of vapor or gaseous refrigerant and the compressor provides a system where pressure drop of the gaseous refrigerant can occur due to fluid line losses and/or temperature loses. While it is possible to insulate this line in order to limit temperature losses, this insulation adds additional cost and complexity to the refrigerant or air-conditioning system as well as presenting problems during the servicing of the system.

Thus, the continued development of vapor injection systems is directed towards increasing the amount and pressure of intermediate pressurized vapor that can be injected into the enclosed spaces.

The present invention provides the art with a vapor injection system where a flash tank, an economizer or a heat exchanger is mounted directly to the hermetic shell of the compressor. The direct attachment of the flash tank, the economizer or the heat exchanger eliminates all external tubing required for the intermediate pressurized gaseous refrigerant. The direct attachment of the flash tank, the economizer or the heat exchanger provides the advantages of a more compact single unit, there is less pressure drop, the installation is easier, it is not necessary to isolate or insulate the vapor injection fluid line, there are fewer components that need to be connected during installation and the refrigeration or air conditioning system will be lower in cost.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
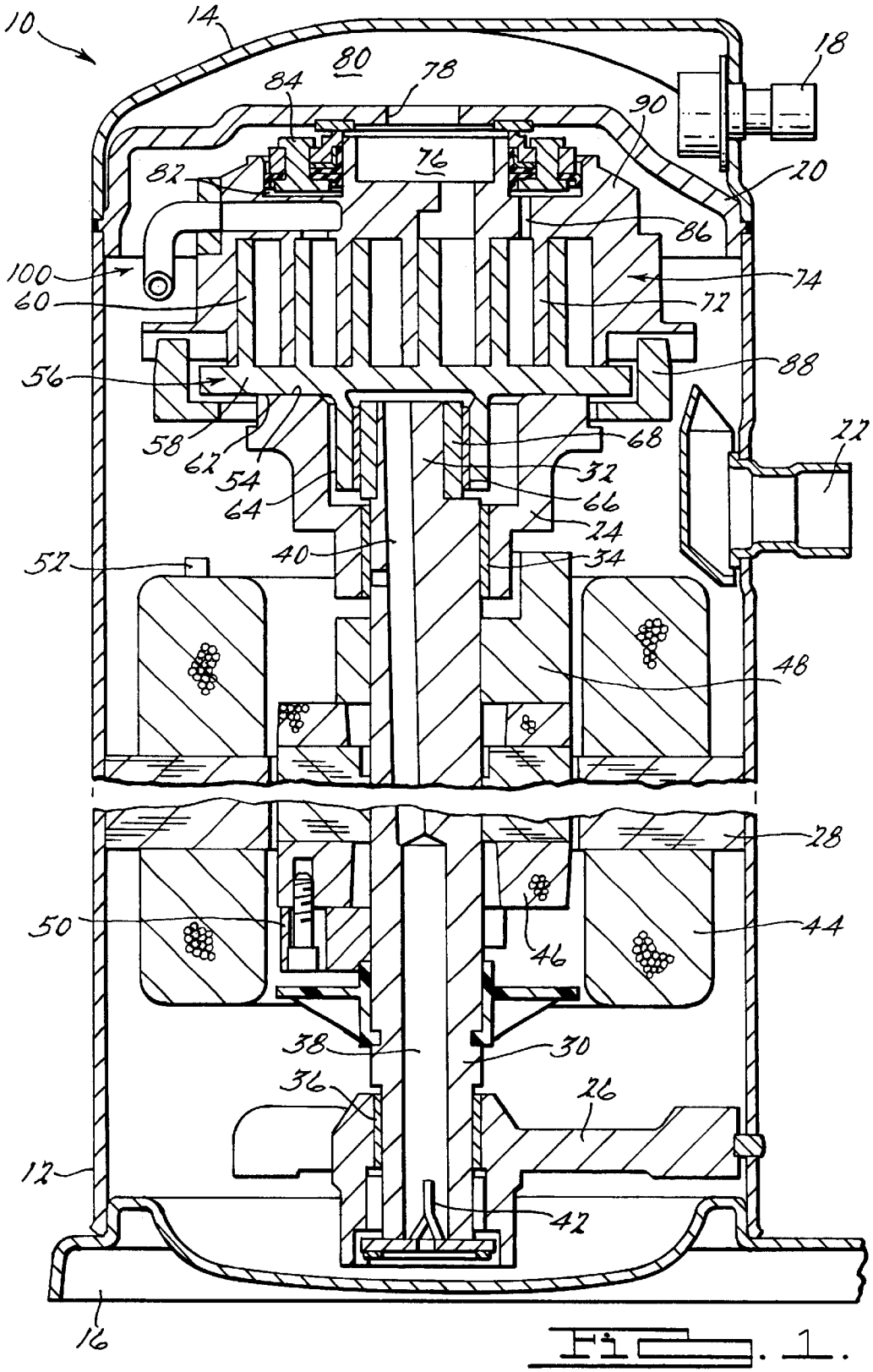
FIG. 1 is a vertical cross-section of a scroll compressor in accordance with the present invention.

Referring now to the drawings in which like reference numerals designate like or corresponding parts throughout the several views, there is shown in FIG. 1, a scroll compressor which is designed to accommodate the unique vapor injection systems in accordance with the present invention and which is designated generally by the reference numeral 10. The following description of the preferred embodiment is merely exemplary in nature and is no way intended to limit the invention, its application or its uses.

Scroll compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to shell 12 include a transversely extending partition 20 which is welded about its periphery at the same point cap 14 is welded to shell 12, an inlet fitting 22, a main bearing housing 24 which is suitably secured to shell 12 and a lower bearing housing 26 having a plurality of radially outwardly extending legs each of which is suitably secured to shell 12. A motor stator 28 which is generally square in cross-section but with the corners rounded off is press fit into shell 12. The flats between the rounded corners on motor stator 28 provide passageways between motor stator 28 and shell 12 which facilitate the return flow of the lubricant from the top of shell 12 to its bottom.

A drive shaft or crankshaft 30 having an eccentric crank pin 32 at the upper end thereof is rotatably journaled in a bearing 34 in main bearing housing 24 and in a bearing 36 in lower bearing housing 26. Crankshaft 30 has at the lower end thereof a relatively large diameter concentric bore 38 which communicates with a radially outwardly located smaller diameter bore 40 extending upwardly therefrom to the top of crankshaft 30. Disposed within bore 38 is a stirrer 42. The lower portion of the interior shell 12 is filled with lubricating oil and bores 38 and 40 act as a pump to pump the lubricating oil up crankshaft 30 and ultimately to all of the various portions of scroll compressor 10 which require lubrication.

Crankshaft 30 is relatively driven by an electric motor which includes motor stator 28 having motor windings 44 passing therethrough and a motor rotor 46 press fitted onto crankshaft 30 and having upper and lower counterweights 48 and 50, respectively. A motor protector 52, of the usual type, is provided in close proximity to motor windings 44 so that if the motor exceeds its normal temperature range, motor protector 52 will de-energize the motor.

The upper surface of main bearing housing 24 is provided with an annular flat thrust bearing surface 54 on which is disposed an orbiting scroll member 56. Scroll member 56 comprises an end plate 58 having the usual spiral valve or wrap 60 on the upper surface thereof and an annular flat thrust surface 62 on the lower surface thereof. Projecting downwardly from the lower surface is a cylindrical hub 64 having a journal bearing 66 therein and in which is rotatively disposed a drive bushing 68 having an inner bore within which crank pin 32 is drivingly disposed. Crank pin 32 has a flat on one surface (not shown) which drivingly engages a flat surface in a portion of the inner bore of drive bushing 68 to provide a radially compliant drive arrangement such as shown in assignee's U.S. Pat. No. 4,877,382, the disclosure of which is incorporated herein by reference.

Wrap 60 meshes with a non-orbiting scroll wrap 72 forming part of a non-orbiting scroll member 74. During orbital movement of orbiting scroll member 56 with respect to non-orbiting scroll member 74 creates moving pockets of fluid which are compressed as the pocket moves from a radially outer position to a central position of scroll members 56 and 74. Non-orbiting scroll member 74 is mounted to main bearing housing 24 in any desired manner which will provide limited axial movement of non-orbiting scroll member 74. The specific manner of such mounting is not critical to the present invention.

Non-orbiting scroll member 74 has a centrally disposed discharge port 76 which is in fluid communication via an opening 78 in partition 20 with a discharge muffler 80 defined by cap 14 and partition 20. Fluid compressed by the moving pockets between scroll wraps 60 and 72 discharges into discharge muffler 80 through port 76 and opening 78. Non-orbiting scroll member 74 has in the upper surface thereof an annular recess 82 having parallel coaxial sidewalls within which is sealing disposed for relative axial movement an annular seal assembly 84 which serves to isolate the bottom of recess 82 so that it can be placed in fluid communication with a source of intermediate fluid pressure by means of a passageway 86. Non-orbiting scroll member 74 is thus axially biased against orbiting scroll member 56 by the forces created by discharge pressure acting on the central portion of non-orbiting scroll member 74 and the forces created by intermediate fluid pressure acting on the bottom of recess 82. This axial pressure biasing, as well as the various techniques for supporting non-orbiting scroll member 74 for limited axial movement, are disclosed in much greater detail in assignee's aforementioned U.S. Pat. No. 4,877,382.

Relative rotation of scroll members 56 and 74 is prevented by the usual Oldham Coupling 88 having a pair of key slidably disposed in diametrically opposing slots in non-orbiting scroll member 74 and a second pair of keys slidably disposed in diametrically opposed slots in orbiting scroll member 56.

Scroll compressor 10 is preferably of the "low side" type in which suction gas entering shell 12 is allowed, in part, to assist in cooling the motor. So long as there is an adequate flow of returning suction gas, the motor will remain within the desired temperature limits. When this flow ceases, however, the loss of cooling will cause motor protector 52 to trip and shut scroll compressor 10 down.

The scroll compressor, as thus broadly described, is either known in the art or it is the subject matter of other pending applications for patent by Applicant's assignee. The details of construction which incorporate the principles of the present invention are those which deal with a unique vapor injection system identified generally by reference numeral 100. Vapor injection system 100 is used to inject vapor or gaseous refrigerant for increasing the capacity and efficiency of scroll compressor 10.

Figure 2:
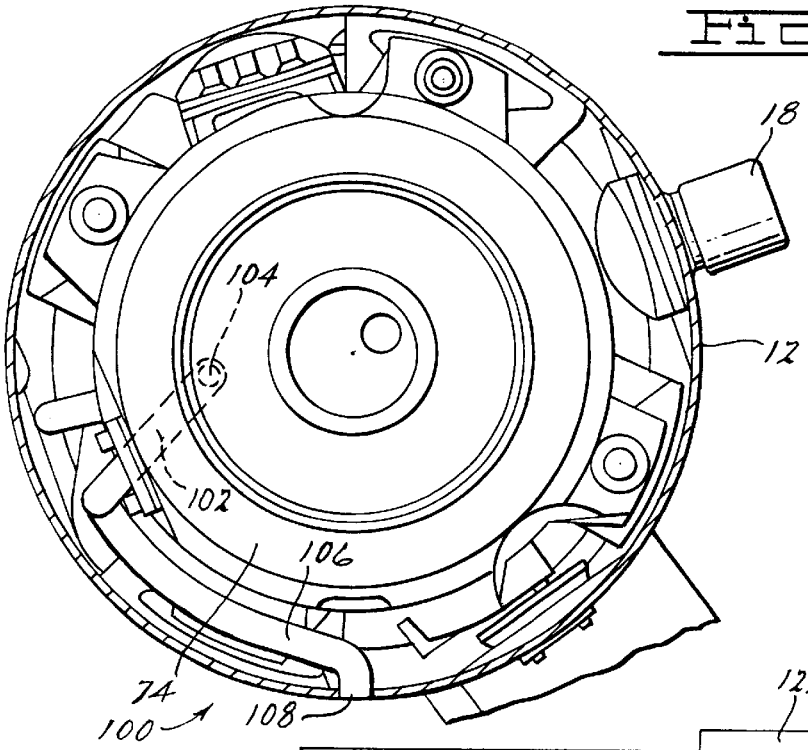
FIG. 2 is a horizontal sectional view of the scroll compressor shown in FIG. 1 taken just below the partition plate.
Figure 3:
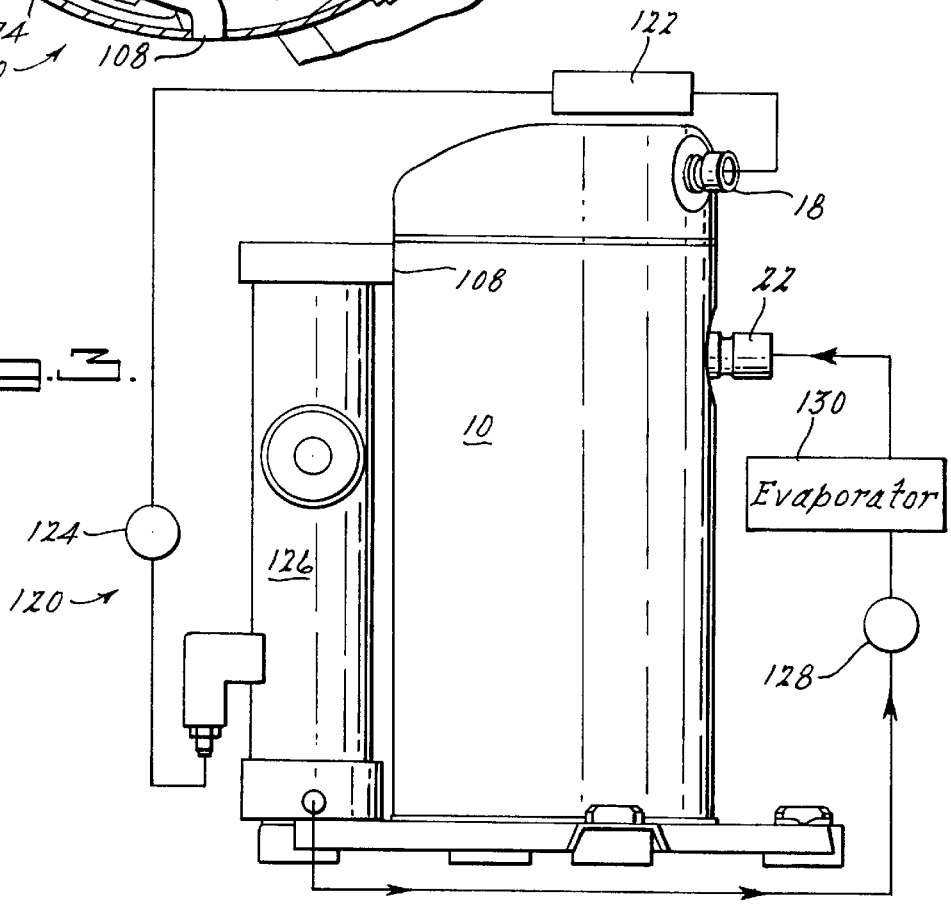
FIG. 3 is a vertical side view of the scroll compressor shown in FIG. 1 with an attached flash tank in accordance with the present invention.

Referring now to FIGS. 1–3, vapor injection system 100 comprises a vapor injection passage 102 extending through an end plate 90 of non-orbiting scroll member 74, a single vapor injection port 104 opening into the enclosed fluid pockets, a connecting tube 106, a fluid injection port 108 extending through shell 12 to the outside of shell 12.

Vapor injection passage 102 is a cross drill feed hole which extends generally horizontal through non-orbiting scroll member 74 from a position on the exterior of non-orbiting scroll member 74 to a position where it communicates with vapor injection port 104. Vapor injection port 104 extends generally vertically from passage 102 through non-orbiting scroll member 74 to open into the enclosed spaces or pockets formed by wraps 60 and 72. Connecting tube 106 extends from vapor injection passage 102 to fluid injection port 108 where it sealingly secures to fluid injection port 108 which is in turn connected to either the flash tank or the heat exchanger of the refrigeration systems described below.

Referring now to FIG. 3, scroll compressor 10 is shown assembled as part of a refrigeration system 120. Refrigeration system 120 comprises scroll compressor 10, a condenser 122, a first expansion device in the form of an expansion valve or fixed orifice 124, a flash tank 126, a second expansion device in the form of an expansion valve 128 and an evaporator 130.

In operation, refrigerant compressed by scroll compressor 10 flows through a fluid line to condenser 122 where the refrigerant is cooled and condensed by removing the heat therefrom. From condenser 122, the liquid refrigerant flows through expansion valve or fixed orifice 124. Expansion valve or fixed orifice 124 reduces the pressure of the refrigerant. From expansion valve or fixed orifice 124, the refrigerant flows to flash tank 126. In flash tank 126, a part of the refrigerant is evaporated due to the decreased pressure, taking the evaporation heat from the remaining liquid refrigerant gathered in the bottom of flash tank 126. This sub-cooled liquid refrigerant from flash tank 126 flows through expansion valve 128 and then through evaporator 130 where it is evaporated by taking up heat. The evaporated refrigerant then flows to the suction chamber of scroll compressor 10 where it will be recompressed and the cycle continues. The flashed or gaseous refrigerant generated in flash tank 126 is routed directed through injection port 108 which extends through shell 12. As described above, connecting tube 106 which is sealingly secured to injection port 108 extends to vapor injection passage 102 which communicates with vapor injection port 104 which opens into one or more of the enclosed spaces defined by scroll wraps 60 and 72. The sub-cooling of the liquid refrigerant in flash tank 126 attained by the above system prior to reaching evaporator 130 increases the refrigeration capacity of evaporator 130 (i.e., a larger enthalapy difference across evaporator 130 is available).

Figure 4:
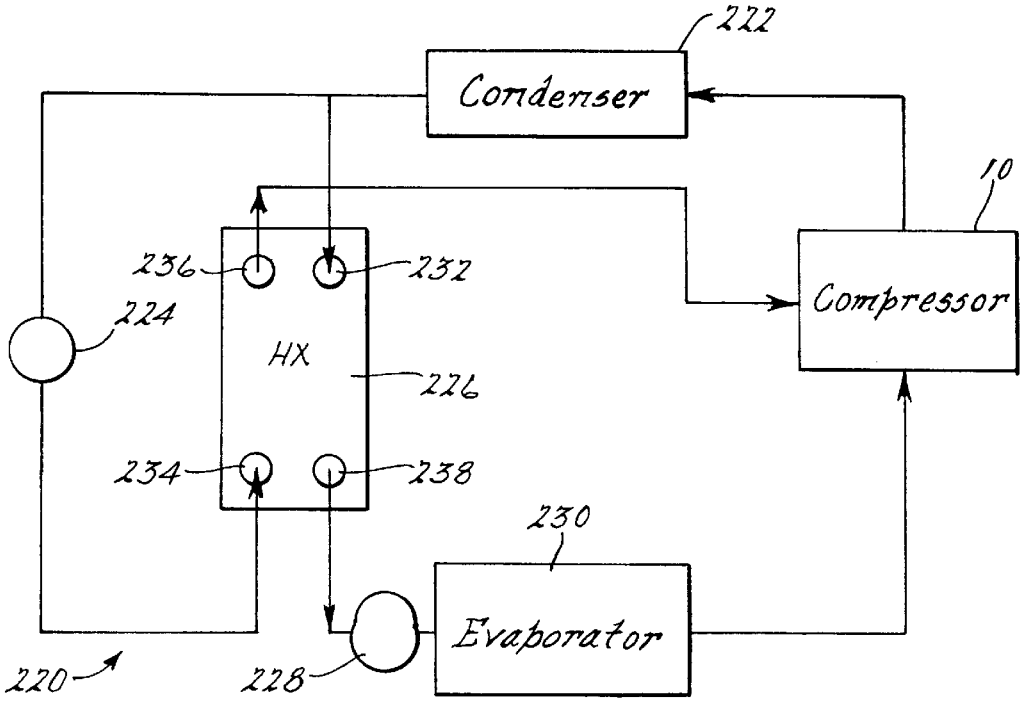
FIG. 4 is a schematic illustration of a heat exchanger utilized with a vapor injection system of a refrigeration system in accordance with another embodiment of the present invention.
Figure 5:
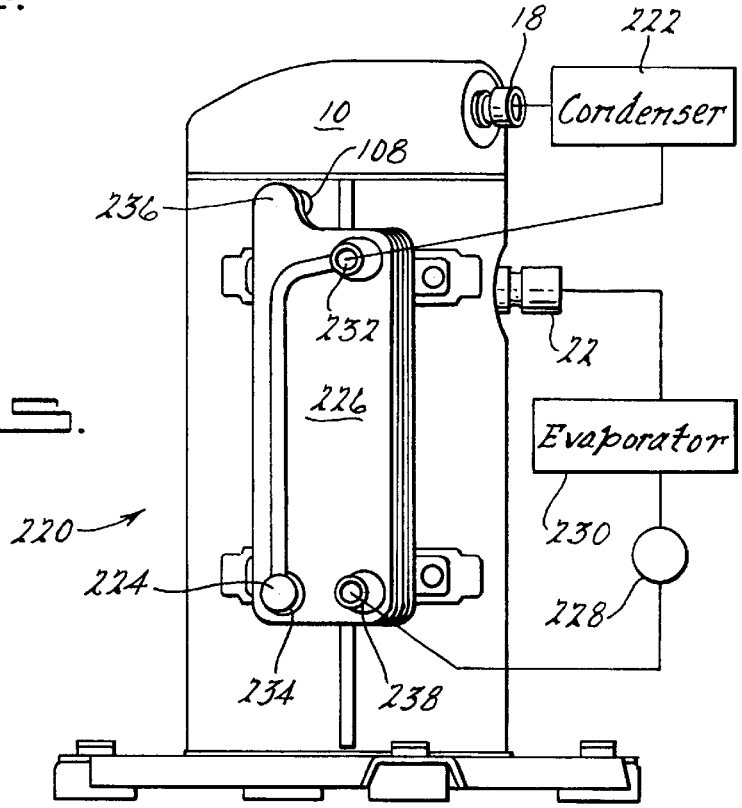
FIG. 5 is a vertical side view of the scroll compressor shown in FIG. 1 in conjunction with a heat exchanger in accordance with the schematic illustration shown in FIG. 4.

Referring now to FIGS. 4 and 5, scroll compressor 10 is shown as part of a refrigeration system 220. Refrigeration system 220 comprises scroll compressor 10, a condenser 222, a first expansion device in the form of an expansion valve or fixed orifice 224, a heat exchanger 226, a second expansion device in the form of an expansion valve 228 and an evaporator 230.

In operation, refrigerant compressed by scroll compressor 10 flows through a fluid line to condenser 222 where the refrigerant is cooled and condensed by removing the heat therefrom. From condenser 222, the liquid refrigerant flows into heat exchanger 226 through a port 232 and also through expansion valve or fixed orifice 224. Expansion valve or fixed orifice 224 reduces the pressure and the temperature of the refrigerant which then reverts back to the gaseous stage. This vaporized refrigerant flows into heat exchanger 226 through a port 234 where it removes additional heat from the liquid refrigerant to sub-cool the liquid refrigerant which was supplied to heat exchanger 226 directly from condenser 222 through port 232. The gaseous refrigerant leaves heat exchanger 226 through a port 236 and is routed directly through injection port 108 which extends through shell 12. As described above, connecting tube 106 which is sealingly secured to injection port 108 extends to vapor injection passage 102 which communicates with vapor injection port 104 which opens into one or more of the enclosed spaces defined by scroll members 60 and 72.

The sub-cooled liquid refrigerant leaves heat exchanger 226 through a port 238 and flows through expansion valve 228 and then through evaporator 230 where it is evaporated by taking up heat. The evaporated refrigerant then flows to the suction chamber of scroll compressor 10 where it will be recompressed and the cycle continues. The sub-cooling of the liquid refrigerant in heat exchanger 226 attained by the above system prior to reaching evaporator 230 increases the refrigeration capacity of evaporator 230 (i.e., a larger enthalapy difference across evaporator 130 is available).

Figure 6:
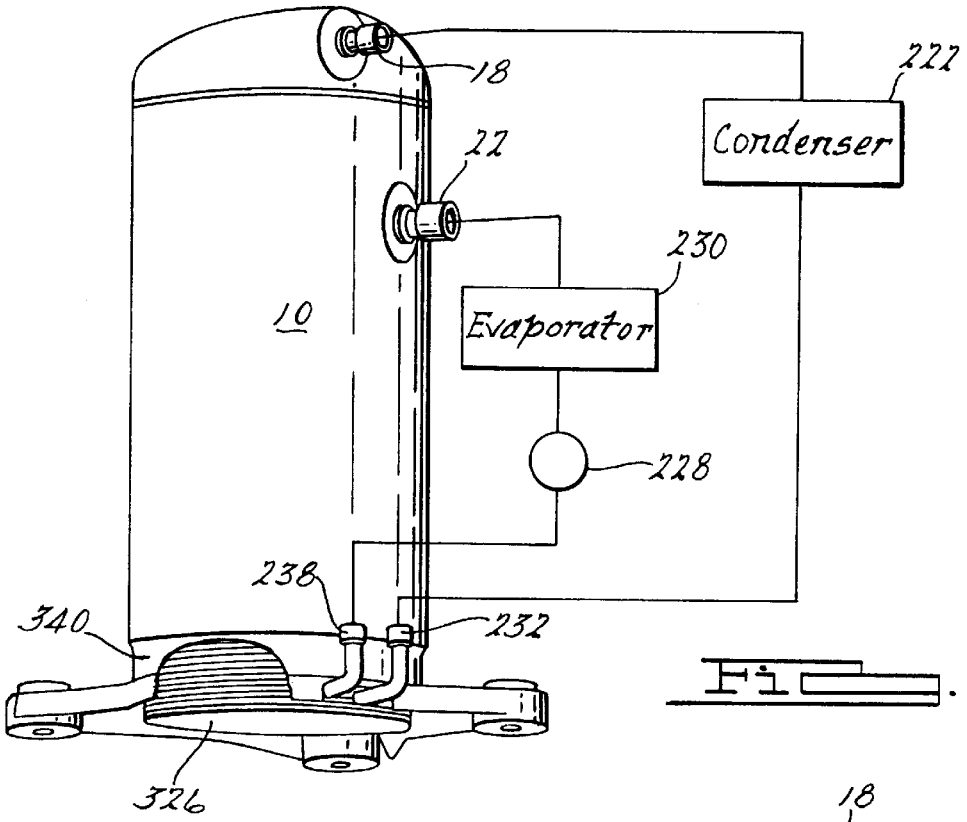
FIG. 6 is a perspective view of the scroll compressor shown in FIG. 1 in conjunction with a heat exchanger in accordance with another embodiment of the present invention.

Referring now to FIG. 6, scroll compressor 10 is shown in conjunction with a heat exchanger 326. Heat exchanger 326 is designed to be placed below scroll compressor 10 within base 16. Base 16 is increased in height using a circular flange 340 to provide space for bottom mounted heat exchanger 326. Heat exchanger 326 includes port 232 from condenser 222, expansion valve or fixed orifice 224 is internal to heat exchanger 326 as well as port 234. Injection port 108 is repositioned to extend through base 16 rather than shell 12 and heat exchanger 326 includes an internal port 236 which mates with injection port 108 extending through base 16. Connecting tube 106 would be reconfigured to mate with injection port 108. Heat exchanger 326 also includes port 238 which is utilized to route the sub-cooled liquid refrigerant to evaporator 230. The operation, function and advantages described above for refrigeration system 220 with heat exchanger 226 are the same for refrigeration system 220 equipped with heat exchanger 326 in place of heat exchanger 226.

Figure 7:
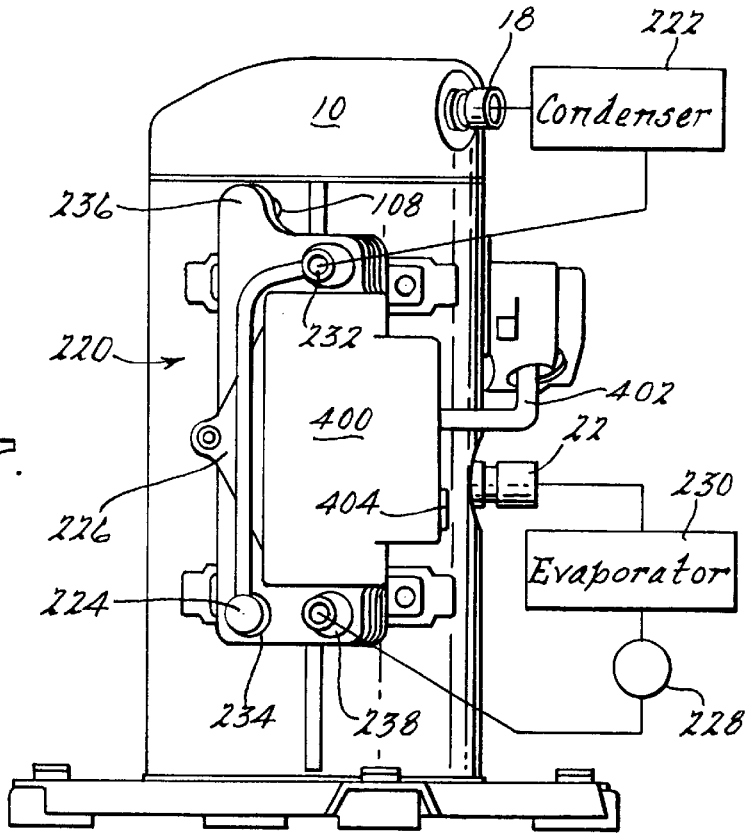
FIG. 7 is a vertical side view of the scroll compressor shown in FIG. 5 in conjunction with a heat exchanger and an inverter in accordance with another embodiment of the present invention.

Referring now to FIG. 7, scroll compressor 10 is shown with refrigeration system 220 including condenser 222, expansion valve or fixed orifice 224, heat exchanger 226, expansion valve 228, evaporator 230 and an inverter 400 mounted on an exterior cooling plate of heat exchanger 226. Thus, FIG. 7 is the same as FIG. 5 with the addition of inverter 400.

Inverter 400 is in electrical communication with scroll compressor 10 through a power line 402. Inverter 400 includes an input terminal 404 which is connected to the source of electrical power that powers inverter 400 and thus scroll compressor 10. During the operation of inverter 400, a significant amount of heat is generated. The capacity of heat exchanger 326 is sufficient to both cool inverter 400 and the liquid refrigerant using the gaseous refrigerant passing through heat exchanger 326. The operation, function and advantages for refrigeration system 220 which includes inverter 400 are the same as those disclosed above for refrigeration system 220 without inverter 400.

All of the above described systems provide the advantages that there is no external vapor injection line. This provides a compact single unit for the compressor and the source of fluid, it reduces the pressure drop of the fluid, it simplifies installation, it eliminates isolation of the vapor injection line, it lessens the number of connections required for installation and it reduces the cost of the system. In addition, the above described systems permit the first expansion device 124, 224 to be an electronic expansion valve, a thermal expansion valve or a fixed orifice.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll machine comprising:

a shell defining an injection port;

a first scroll member disposed in said shell and having a first scroll wrap extending from a first end plate;

a second scroll member disposed in said shell and having a second scroll wrap extending from a second end plate, said second scroll wrap being intermeshed with said first scroll wrap to define at least two moving pockets which decrease in size as they move from a radially outer position to a radially inner position upon relative orbital movement of said scroll wraps;

a vapor injection passage extending through one of said first and second scrolls, said vapor injection passage extending between said injection port and one of said moving pockets;

a source of vapor in communication with said vapor injection passage through said injection port, said source of vapor being secured to said shell for providing vapor directly to said injection port.

2. The scroll machine according to claim 1 wherein said source of vapor is a flash tank.

3. The scroll machine according to claim 1 wherein said source of vapor is a heat exchanger.

4. The scroll machine according to claim 3 wherein said heat exchanger is secured to a side of said shell.

5. The scroll machine according to claim 3 wherein said heat exchanger is secured to a bottom of said shell.

6. The scroll machine according to claim 1 wherein said source of vapor is secured to a side of said shell.

7. The scroll machine according to claim 1 wherein said source of vapor is secured to a bottom of said shell.

8. The refrigeration system according to claim 1 wherein said scroll machine is powered by an inverter controlled motor, said inverter being in heat transfer contact with said source of vapor.

9. A refrigeration system comprising:

a condenser;

a first expansion device in communication with said condenser;

a source of fluid in communication with said expansion device;

a second expansion device in communication with said source of fluid;

an evaporator in communication with said second expansion device; and a compressor in communication with said evaporator, said condenser and said source of fluid, said compressor comprising:

a shell defining an injection port, said source of fluid being secured to said shell to sealingly engage said injection port;

a first scroll member disposed in said shell and having a first scroll wrap extending from a first end plate;

a second scroll member disposed in said shell and having a second scroll wrap extending from a second end plate, said second scroll wrap being intermeshed with said first scroll wrap to define at least two moving pockets which decrease in size as they move from a radially outer position to a radially inner position upon relative orbital movement of said scroll wraps; and a fluid injection passage extending through one of said first and second scrolls, said fluid injection passage extending between said source of fluid and one of said moving pockets through said injection port.

10. The refrigeration system according to claim 9 wherein said first expansion device is a fixed orifice.

11. The refrigeration system according to claim 9 wherein said source of fluid is a flash tank.

12. The refrigeration system according to claim 11 wherein said first expansion device is a fixed orifice.

13. The refrigeration system according to claim 9 wherein said source of fluid is a heat exchanger.

14. The refrigeration system according to claim 13 wherein said first expansion device is a fixed orifice.

15. The refrigeration system according to claim 13 wherein said heat exchanger is in communication with said condenser.

16. The refrigeration system according to claim 13 wherein said heat exchanger is secured to a side of said shell.

17. The refrigeration system according to claim 13 wherein said heat exchanger is secured to a bottom of said shell.

18. The refrigeration system according to claim 9 wherein said source of fluid is secured to a side of said shell.

19. The refrigeration system according to claim 9 wherein said source of fluid is secured to a bottom of said shell.

20. The refrigeration system according to claim 9 wherein said compressor is powered by an inverter controlled motor, said inverter being in heat transfer contact with said source of fluid.

21. A scroll compressor comprising:

a shell;

a first scroll member disposed in said shell having a first scroll wrap extending from a first end plate;

a second scroll member disposed in said shell having a second scroll wrap extending from a second end phase, said second scroll wrap being intermeshed with said first scroll wrap to define at least two moving pockets which decrease in size as they move from a radially outer position to a radially inner position upon relative orbital movement of said scroll wraps;

an electric motor for powering said scroll members;

an inverter in electrical communication with said electric motor;

a heat exchanger in communication with fluid compressed by said scroll compressor at a first pressure and fluid compressed by said scroll compressor at a second pressure, said second pressure being different than said first pressure, said heat exchanger being secured to said shell, said inverter being in heat transfer contact with said heat exchanger.

22. A scroll compressor comprising:

a shell;

a first scroll member disposed in said shell having a first scroll wrap extending from a first end plate;

a second scroll member disposed in said shell having a second scroll wrap extending from a second end phase, said second scroll wrap being intermeshed with said first scroll wrap to define at least two moving pockets which decrease in size as they move from a radially outer position at a suction pressure to a radially inner position at a discharge pressure upon relative orbital movement of said scroll wraps;

an electric motor for powering said scroll members;

an inverter in electrical communication with said electric motor;

a heat exchanger in communication with fluid compressed by said scroll compressor, said fluid being at a pressure greater than said suction pressure, said heat exchanger being secured to said shell, said inverter being in heat transfer contact with said heat exchanger.

* * * * *

UNITED STATES PATENT AND TRADEMARK OFFICE

CERTIFICATE OF CORRECTION

PATENT NO. : 6,655,172 B2 
DATED : December 2, 2003
INVENTOR(S) : Michael Perevozchikov and Roy Doepker It is certified that error appears in the above-identified patent and that said Letters Patent is hereby corrected as shown below:

Column 4,
Line 6, " 'as" should be -- as --.
Line 44, "Coupling" should be -- coupling --.
Line 45, "key" should be -- keys --.

Column 5,
Line 40, "directed" should be -- directly --.

Column 8,
Line 53, "phase" should be -- plate --.

Column 9,
Line 10, "phase" should be -- plate --.

Signed and Sealed this

Twenty-third Day of March, 2004

JON W. DUDAS
*Acting Director of the United States Patent and Trademark Office*